US005946864A

United States Patent [19]

Simpson

[11] Patent Number: 5,946,864

[45] Date of Patent: Sep. 7, 1999

[54] DECORATIVE SOFFIT-FASCIA SYSTEM

[75] Inventor: Kenneth Simpson, Carew Newton, United Kingdom

[73] Assignee: Newmond Building Products Limited, United Kingdom

[21] Appl. No.: 09/047,650

[22] Filed: Mar. 25, 1998

[30] Foreign Application Priority Data

Mar. 27, 1997 [GB] United Kingdom ..... 9706449

[51] Int. Cl.[6] ..... E04B 7/00

[52] U.S. Cl. ..... 52/94

[58] Field of Search ..... 52/94

[56] References Cited

U.S. PATENT DOCUMENTS 4,461,128 7/1984 Knoebl ..... 52/94

FOREIGN PATENT DOCUMENTS

0360465 A1 3/1990 European Pat. Off. .
2126266 3/1984 United Kingdom .
2271588 4/1994 United Kingdom .
2247258 11/1994 United Kingdom .
2306979 5/1997 United Kingdom .
WO83/02636 8/1983 WIPO .

*Primary Examiner*—Creighton Smith
*Attorney, Agent, or Firm*—Peter J. Manus, Esq.

[57] ABSTRACT

A soffit fascia system 1 comprising a horizontal soffit 2 and a vertical fascia 9 has secured thereto, by means of a fixing channel 7 that engages the edge 2*a* of the soffit 2, a member 6 having a decorative portion 8 which, when in position, depends from soffit 2.

The end 9*a* of the fascia 9 extends below the soffit 2 and contacts the closed end 7*a* of the fixing channel 7 and the shoulder 20 of the member 6. The face of the fascia 9 and the decorative portion 8 lie in the same plane.

The decorative portion 8 is provided with corresponding male 17 and female clip attachments on opposing ends which allow the decorative portions 8 to be secured one to another in a run by positive clipping action.

22 Claims, 5 Drawing Sheets

DECORATIVE SOFFIT-FASCIA SYSTEM

The present invention relates to articles for attachment to a soffit-fascia system to add a decorative finish to a building.

It is known in the art to produce fascias and barge boards having patterns cut out to add a decorative finish, however such decorative fascias and bargeboards are difficult to manufacture, to secure in place and, also, are costly to repair and replace. It is also known to cover existing fascias or barge boards with decorative portions or to append the decorative portions from the barge board. The method of attachment can be complex and careful cutting of the decorative portion is often required.

The object of the present invention is to provide a decorative finish to the fascia or barge boards of a building using members which are easily attached to a soffit-fascia system.

According to a first aspect the present invention provides a soffit-fascia system comprising a soffit, a fascia and a member adapted to be secured to and to depend (extend downwardly) from the soffit, the member comprising a decorative portion and a fixing portion including an element extending rearwardly of the decorative portion and adapted to co-operate with the soffit, and the fascia extending adjacent an upper surface of the decorative portion.

Preferably the upper surface of the decorative portion is the upper edge thereof.

Preferably the element is a channel dimensioned to receive an edge portion of the soffit.

The fascia preferably extends to contact an element of the decorative portion parallel to the soffit; preferably the element is a shoulder, most preferably the shoulder extends inwardly of the upper surface of the decorative portion.

Preferably the shoulder is located below the first element.

The fascia may extend downwardly beyond the fixing channel and the edge of the soffit.

Preferably the face of the fascia and the face of the decorative portion are in the same vertical plane.

It is to be understood that in the context of the present application the term fascia is intended to include barge board.

Where the decorative member is to be fixed to a long run of soffit several decorative members positioned end to end will be required. Preferably the end portions of adjacent decorative members extending along the length of soffit are secured to one another by a positive clipping action of intergaging elements located on the end portion of the members. Thus one end of the decorative member is preferably provided with a female clip attachment and the other end with a male clip attachment whereby the end portions of adjacent members are in mating contact to provide a planar surface. An advantage of positive clipping is that each joint is properly aligned.

Preferably one end of the decorative member is provided with a locating member, this locating member may be secured to the rear face of one end of a decorative portion and extends behind the rear face of the mating end portion of an adjacent decorative portion when the two portions are in mating contact.

Preferably plain mouldings are provided for use near the ends of the soffit to provide easy length adjustment and a simplified finish to the decorative member.

Decorative infills may be provided for use with the decorative member. The infills may be of a contrasting colour to the decorative member or they may provide further decorative features.

The decorative infill preferably push fits into an aperture in the decorative member.

The joints between decorative members fixed along the long run of soffit may be at least partially obscured by a further decorative device to break up the straight join line and increase the impression of continuity.

Preferably an end plug is provided to seal the free ends of the decorative members or the plain end moulding when a complete run of decorative members have been put in position. Preferably the plug is solid to allow cutting at the required angle. The plug may be secured to the decorative member or plain end spacer by means of a push fit attachment.

Two embodiments of the invention will now be described in detail with reference to the drawings in which.

Figure 1:
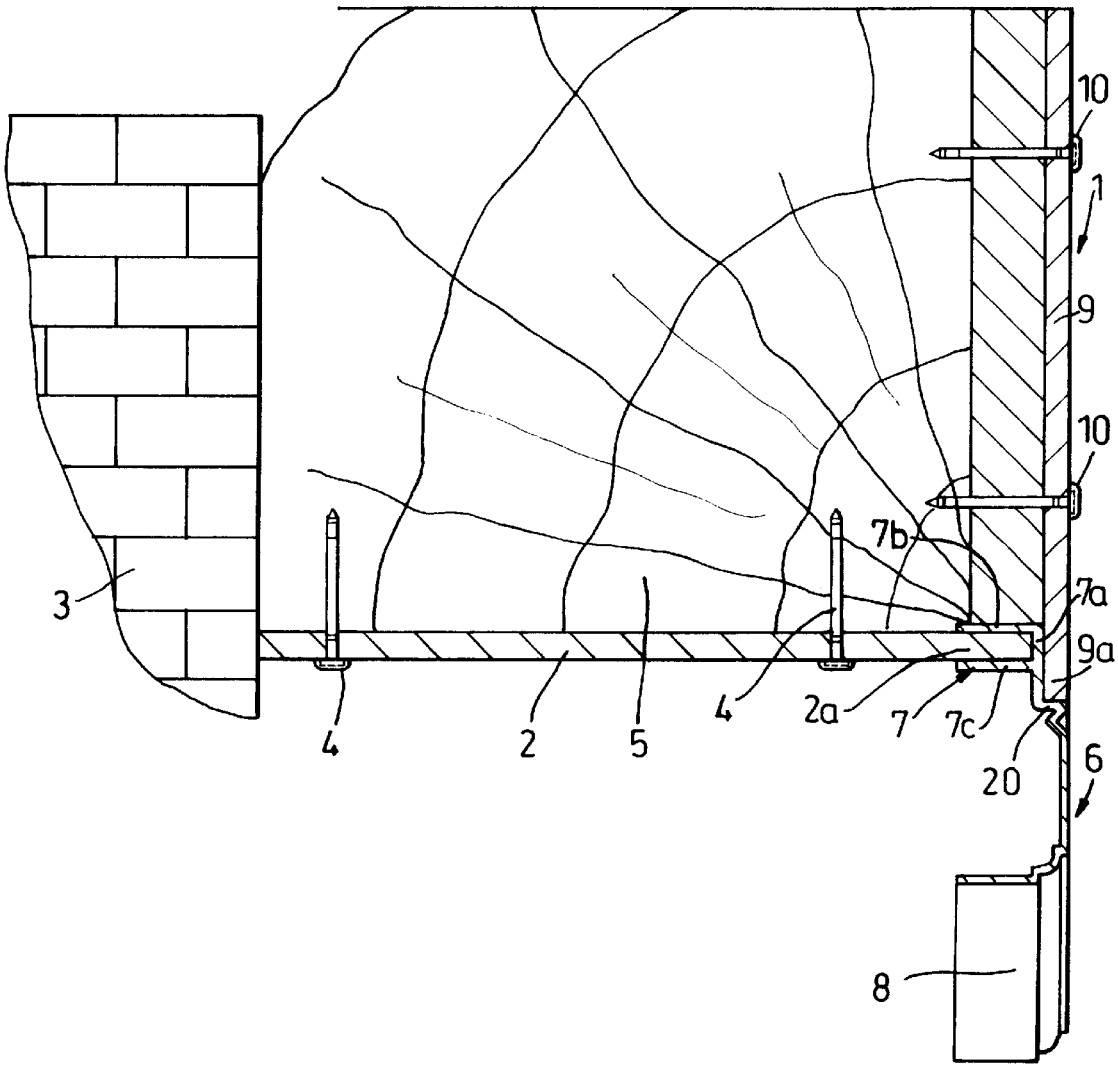
FIG. 1 is a cross section of the soffit-fascia system of a first embodiment of the present invention.
Figure 3B:
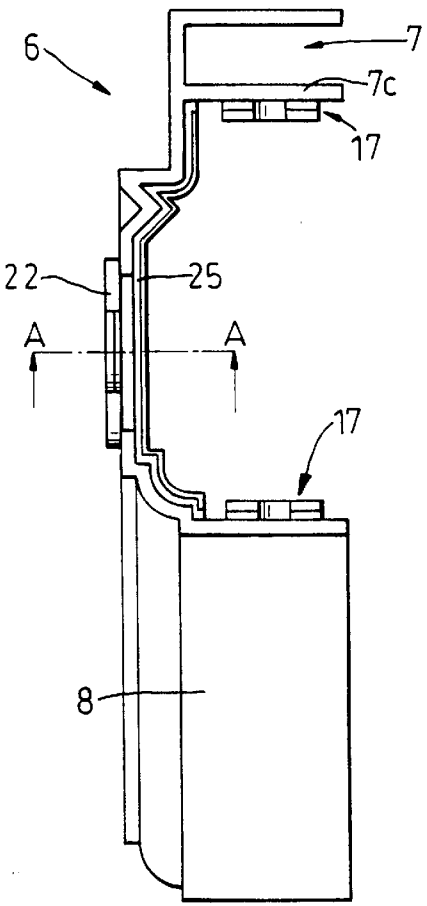
Figure 3A:
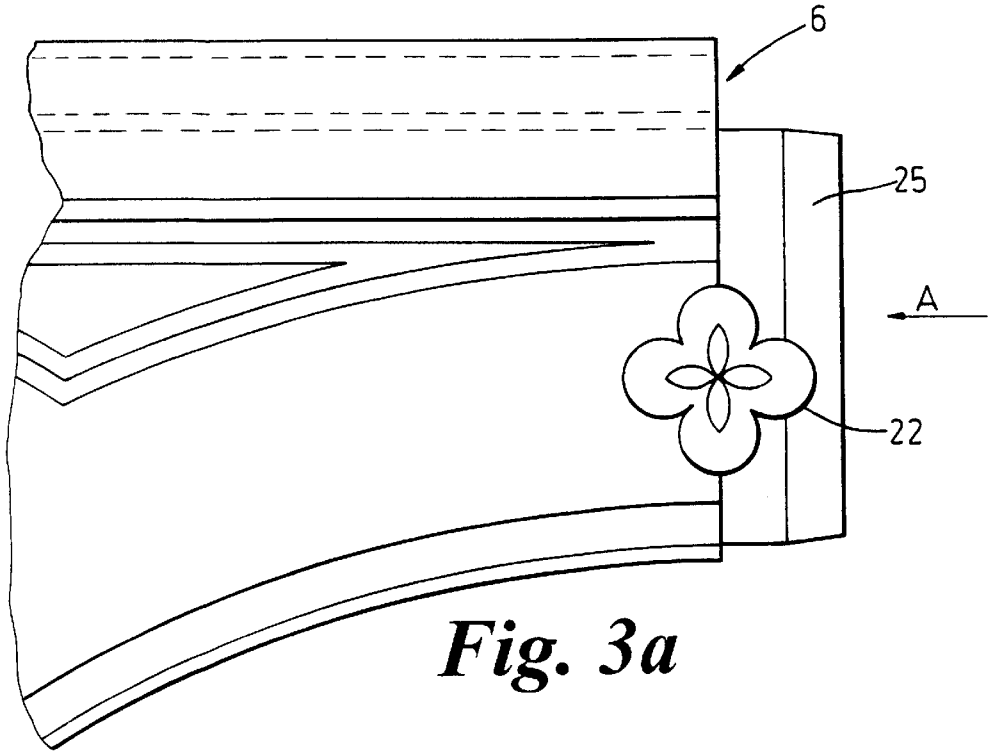
Figure 3D:
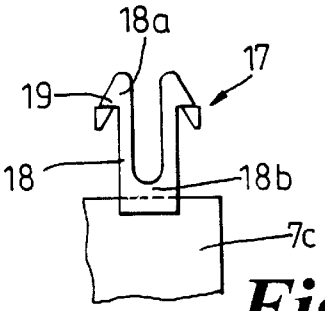
Figure 3C:
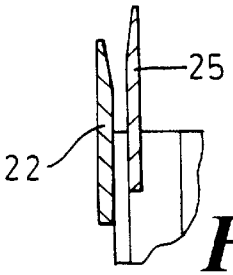
Figure 4:
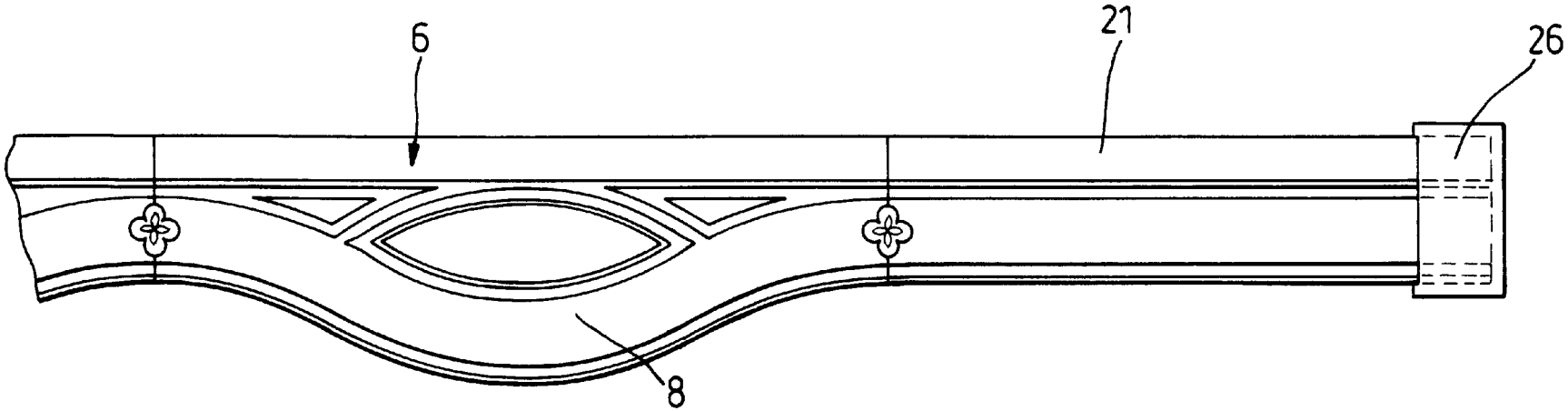

FIG. 3*a* shows a front view of a decorative member as in the FIG. 1 embodiment having male clipping means and a locating member;

FIG. 3*b* shows an end view of the decorative member of FIG. 3*a* in the direction of arrow A;

FIG. 3*c* shows a section A—A of FIG. 3B;

FIG. 3*d* shows the male clip attachment;

FIG. 4 shows the use of a plain end spacer; and

Figure 5A:
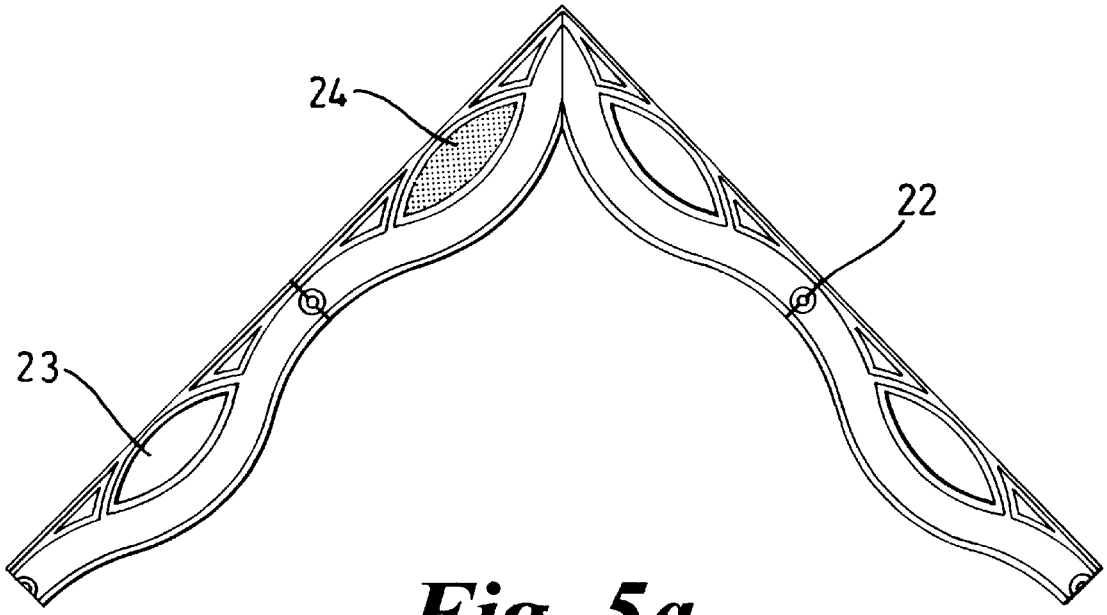
Figure 5B:
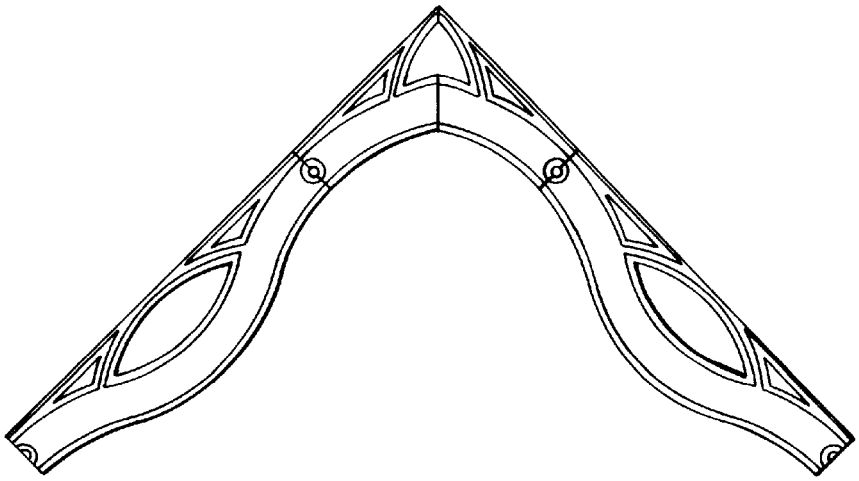

FIGS. 5*a* and 5*b* show decorative finishes which can be achieved by variation of cutting plane in the decorative member illustrated in FIG. 4.

The soffit, fascia and decorative member including the fixing channel are made from UPVC in both embodiments of the invention.

FIG. 1 shows a soffit-fascia system 1 comprising a soffit 2 extending horizontally from a building wall 3 and being secured by screws 4 to a noggin 5. A member 6, comprising a fixing channel 7 having upper and lower lips 7*b*, 7*c* and a closed end 7*a* and a decorative portion 8 is attached to the edge 2*a* of the soffit 2; edge 2*a* of soffit 2 is received in fixing channel 7 whereby the decorative portion 8 depends from the soffit 2. The width of the soffit 2 is less than the distance between the building wall 3 and the rear face of the fascia 9 to allow the edge of the soffit 2*a* to be received in the fixing channel 7 and the fascia 9 to contact the closed end 7*a* of fixing channel 7. The fascia 9 is secured to the noggin 5 at right angles to the soffit 2, or where there is an existing wooden fascia the fascia 9 is secured to that, by screws 10. The end 9*a* of the fascia 9 extends below the soffit 2 and contacts the closed end 7*a* of the fixing channel 7. The member 6 is provided with a shoulder 20 which extends outwardly parallel to and below the fixing channel. The end 9*a* of the fascia 9 contacts the shoulder 20 and the decorative portion 8 depends from the shoulder such that the face of the fascia 9 and the face of the decorative portion 8 lie in the same plane.

Figure 2:
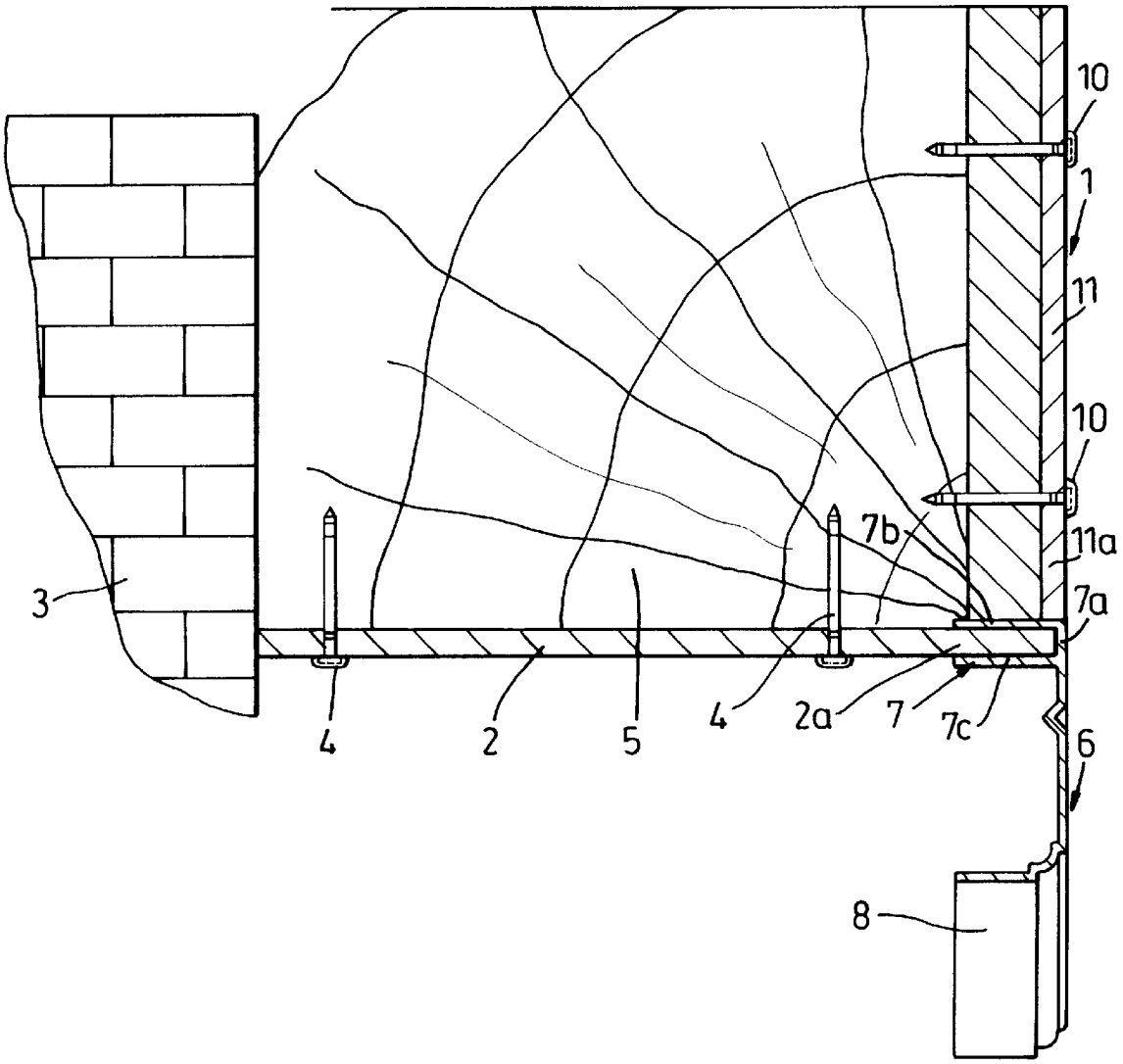
FIG. 2 is a cross section through the soffit-fascia system of a second embodiment of the present invention.

FIG. 2 shows a soffit-fascia system of the second embodiment in which like features are given the same reference numeral. In FIG. 2 the fascia 11 is secured to an existing wooden fascia or to the noggin 5 at right angles to the soffit 2 such that its end 11*a* contacts the upper lip 7*b* of the fixing channel 7 and does not extend below the soffit.

FIGS. 3*a* and *b* show the decorative portion 8 of member 6 which is provided with male clip attachments 17, one located on the underside of the lower lip 7*c* of the fixing channel 7 and another located on the rear of the decorative portion 8. Each member 6 is provided with an elongate locating member 25 at the end bearing the male clip attachments 17 to enable two elements to remain correctly aligned once clipped together and a decorative device 22 is moulded onto the decorative portion 8 to cover the joints and provide continuity of design.

FIG. 3*c* shows a scrap section across the end of the decorative member bearing the locating member 25 on its rear face and the decorative device 22 on its front face and having a space therebetween to receive the opposite end of an adjacent decorative member 8 therein.

As shown in FIG. 3*d* the male clip attachment 17 comprises flexible arms 18 joined at the end 18*b*, being spaced slightly apart and having lugs 19 on the end 18*a*.

It is to be understood that the member to be joined to the member 6 (e.g. moulding 21 in FIG. 4) does not include a locating member 25 but is provided with female clip attachments (not shown) opposed to the male clip attachment 17.

The arms 18 of the male clip attachment 17 can be pressed together to fit into an aperture in a corresponding female clip attachment located on the opposite end of the decorative member 8 and are of a suitable length to enable the lugs 19 to protrude from the aperture when fully inserted and the arms 18 to regain their slightly spaced apart position. This provides a positive clipping action which secures the members 6 together when more than one member 6 is needed to extend along a long run of the soffit 2.

FIG. 4 shows the use of a plain moulding 21 near the ends of the soffit. Once the decorative member has been cut to give the desired decorative finish e.g. at the gable end, the plain moulding is the only other part of the system which needs to be cut to give the correct length adjustment. The plain moulding 21 is joined to the member 6 by the clipping action shown in FIGS. 3*a, b, c*.

The plain end moulding 21, or the decorative member 8 if a plain end spacer 21 is not used, is provided with a solid end plug 26 which can be cut at the required angle and is secured to the plain end moulding 21 or decorative member 8 by means of a push fit attachment.

FIGS. 5*a* and 5*b* show examples of two decorative effects which can be obtained from the same member 6 by butting the ends of the decorative portions at the gable end. The member 6 can be cut at any point along its length and at any angle owing to the fact that the fixing channel 7 runs along the complete length of the member 6 and therefore the member 6 can be attached to the soffit 2 at any point along its length. As a result a large number of decorative finishes at the gable end can be obtained from a member having a of decorative portion 8 at only one design.

The decorative portion of the member 6 is provided with apertures 23 into which decorative infills 24 of a contrasting colour or additional decorative features can be inserted by means of a snap-fit engagement.

In use, referring to the embodiment of FIG. 4, the end of the member 21 is aligned with member 6 such that the locating member 25 is received behind the member 21 and the decorative device 22 is received in front of the member 21 and the male clip attachments 17 engage the corresponding female clip attachments by passing through the aperture such that the lugs 19 protrude from the aperture and secure the two members 6 and 21 together by a positive clipping action. The decorative device 22 which is moulded onto the member 6 at the end having the male attachment clips 17 covers part of the join and gives continuity of design.

I claim:

1. A soffit-fascia system comprising a soffit, a fascia and at least one member secured to and to extend downwardly from said soffit, said member comprising a decorative portion and a fixing portion, said fixing portion including a first element extending rearwardly of said decorative portion and secured to said soffit, said fascia extending adjacent an upper surface of said decorative portion, and wherein the face of said fascia and the face of said decorative portion are in the same vertical plane.

2. The system according to claim 1 wherein said upper surface of said decorative portion is the upper edge thereof.

3. The system according to claim 1 wherein said first element is a channel dimensioned to receive an edge portion of said soffit.

4. The system according to claim 1 wherein said fascia extends to contact a second element of said decorative portion parallel to said soffit.

5. The system according to claim 4 wherein said second element is a shoulder extending inwardly of said upper surface of said decorative portion.

6. The system according to claim 5 wherein said shoulder is located below said first element.

7. The system according to claim 1 wherein said fascia extends downwardly beyond said first element and the edge of said soffit.

8. The system according to claim 1 wherein mating end portions of adjacent members extending along the length of said soffit are secured to one another by interengaging elements located on said end portions of said members.

9. The system according to claim 8 wherein one end of each said member includes a female clip attachment and the other end with a male clip attachment whereby said end portions of said adjacent members are in mating contact to provide a planar surface.

10. The system according to claim 1 wherein one end of said member includes a locating member.

11. The system according to claim 10 comprising at least two of said members extending along a length of said soffit and including a locating member secured to the rear face of one end of said decorative portion of one of said members and extending behind the face of said mating end portion of said adjacent decorative portion.

12. A soffit-fascia system comprising a soffit, a fascia and a member secured to and to extend downwardly from said soffit, said member comprising a decorative and a fixing portion, said fixing portion including a first element extending rearwardly of said decorative portion and cooperating with said soffit, said fascia extending adjacent an upper surface of said decorative portion and wherein the face of said fascia and the face of said decorative portion are in the same vertical plane, a locating member secured to the rear face of one end of said decorative portion of one of said members and extending behind the face of said mating end portion of said adjacent decorative portion, wherein mating end portion of adjacent decorative portions extending along the length of said soffit are secured to one another by interengaging elements located on said end portion of said decorative portions.

13. The system according to claim 12 wherein joints between said members fixed along a long run of soffit are at least partially obscured by a further decorative device.

14. The system according to claim 12 including plain mouldings for use near the ends of said soffit to provide length adjustment.

15. The system according to claim 12 including decorative infills for use with said member.

16. The system according to claim 12 wherein said decorative infill push fits into an aperture in said decorative member.

17. The system according to claim 12 including an end plug to seal the free ends of said members when a complete run of said members have been put in position.

18. The system according to claim 17 wherein said plug is solid to allow cutting at the required angle.

19. The system according to claim 17 wherein said plug is secured to said member by means of a push fit attachment.

20. The system according to claim 14 including an end plug to seal free ends of said plain molding when a complete run of said members have been put in position.

21. The system according to claim 20 wherein said plug is solid to allow cutting at the required angle.

22. The system according to claim 20 wherein said plug is secured to said plain moldings by means of a push fit attachment.

* * * * *